US012228354B2

(12) United States Patent
Azzouz et al.

(10) Patent No.: US 12,228,354 B2
(45) Date of Patent: Feb. 18, 2025

(54) ADAPTER FOR A HEAT EXCHANGER HEADER

(71) Applicant: Valeo Systemes Thermiques, Le Mesnil Saint Denis (FR)

(72) Inventors: Kamel Azzouz, Le Mesnil Saint Denis (FR); Julien Tissot, Le Mesnil Saint-Denis (FR); Sébastien Garnier, Le Mesnil Saint Denis (FR); Patrick Leblay, Le Mesnil Saint-Denis (FR); Michael Lissner, Le Mesnil Saint Denis (FR); Cédric De Vaulx, Le Mesnil Saint Denis (FR)

(73) Assignee: VALEO SYSTEMES THERMIQUES, Le Mesnil-Saint-Denis (FR)

( * ) Notice: Subject to any disclaimer, the term of this patent is extended or adjusted under 35 U.S.C. 154(b) by 64 days.

(21) Appl. No.: 17/279,421

(22) PCT Filed: Sep. 25, 2019

(86) PCT No.: PCT/FR2019/052270
§ 371 (c)(1),
(2) Date: Mar. 24, 2021

(87) PCT Pub. No.: WO2020/065225
PCT Pub. Date: Apr. 2, 2020

(65) Prior Publication Data

US 2022/0011061 A1 Jan. 13, 2022

(30) Foreign Application Priority Data

Sep. 25, 2018 (FR) ..... 1858764

(51) Int. Cl.
*F28F 9/02* (2006.01)

(52) U.S. Cl.
CPC ..... *F28F 9/0246* (2013.01)

(58) Field of Classification Search
CPC ..... F28F 9/0246; F28F 9/0248; F28F 9/0251; F28F 9/0256
(Continued)

(56) References Cited

U.S. PATENT DOCUMENTS 4,002,201 A * 1/1977 Donaldson ..... F28F 3/04 165/166
4,011,905 A * 3/1977 Millard ..... F28F 3/042 165/41
(Continued)

FOREIGN PATENT DOCUMENTS

EP 1452816 A2 9/2004
FR 2986315 A1 * 8/2013 ..... F28D 9/005
(Continued)

OTHER PUBLICATIONS

International Search Report with Written Opinion in corresponding International Application No. PCT/FR2019/052270, mailed Nov. 26, 2019 (10 pages).

*Primary Examiner* — Raheena R Malik
(74) *Attorney, Agent, or Firm* — Osha Bergman Watanabe & Burton LLP

(57) ABSTRACT

The invention relates to an adapter (8) for connecting a header (5) of a heat exchanger (i) having a header cross section (25) to a manifold (6) having a manifold cross section (26) which has a different shape from the shape of the header cross section (25). An adapter (8) connects the header cross section (25) to the manifold cross section (26). The adapter (8) can be in one piece with a first end plate (3*a*) of the heat exchanger (i) or it can be an independent part. Application to plate heat exchangers.

8 Claims, 2 Drawing Sheets

(58) Field of Classification Search
USPC ..... 165/175
See application file for complete search history.

(56) References Cited

U.S. PATENT DOCUMENTS 4,415,024 A * 11/1983 Baker ..... F28D 7/1661 165/DIG. 405
4,614,231 A * 9/1986 Proctor ..... F28F 9/0246 165/178
4,872,578 A * 10/1989 Fuerschbach ..... F28D 9/005 165/166
5,964,280 A * 10/1999 Wehrmann ..... F28F 9/0246 165/145
5,964,282 A * 10/1999 Seiler ..... F28F 9/001 165/170
6,170,567 B1 * 1/2001 Nakada ..... F28D 1/0375 165/175
6,247,528 B1 * 6/2001 Blomgren ..... F28D 9/005 165/178
6,257,325 B1 * 7/2001 Watanabe ..... F28F 9/0246 165/175
6,814,133 B2 * 11/2004 Yamaguchi ..... F28D 9/0012 165/41
9,453,690 B2 * 9/2016 Martin ..... F28D 1/0333
2011/0303402 A1 * 12/2011 Gu ..... F28F 9/0251 165/182
2012/0234523 A1 * 9/2012 Jouanny ..... F28F 9/0246 165/166
2014/0338873 A1 * 11/2014 Leroux ..... F28D 9/0031 165/172
2016/0097596 A1 * 4/2016 Stewart ..... F28F 1/128 165/175
2017/0016685 A1 * 1/2017 Hohmann ..... F28F 21/06
2017/0227302 A1 * 8/2017 Draenkow ..... F28F 3/08
2017/0336147 A1 * 11/2017 Diéguez Fortes .... F28F 9/0265
2018/0195739 A1 * 7/2018 Kawachi ..... F28F 9/0246
2019/0120563 A1 * 4/2019 Nguyen ..... F28D 9/0056
2019/0186837 A1 * 6/2019 Fukada ..... F28F 9/0256
2021/0341228 A1 * 11/2021 Tissot ..... F28D 9/0043
2021/0396479 A1 * 12/2021 Tissot ..... F28F 3/046
2022/0003346 A1 * 1/2022 Ryman ..... F16L 37/008
2022/0003510 A1 * 1/2022 Ryman ..... F28F 9/0258
2022/0011061 A1 * 1/2022 Azzouz ..... F28F 9/0246

FOREIGN PATENT DOCUMENTS

WO 98/59208 A1 12/1998
WO 2013/092638 A1 6/2013

* cited by examiner

ADAPTER FOR A HEAT EXCHANGER HEADER

The field of the present invention is that of heat exchangers, notably automotive heat exchangers.

Motor vehicles are commonly equipped with heat exchangers. These allow calories to be transferred from one fluid to another fluid and are used, for example, to cool internal combustion engines.

Some of these exchangers are plate exchangers, and they are used to cool liquids such as oil. These exchangers comprise a stack of plates between which a plurality of spaces are formed. This stack of plates constitutes the heating body of the heat exchanger.

The effectiveness of these heat exchangers depends on the intensity of the heat exchange between the fluids, but also on the distribution of the fluids in the spaces. The plate heat exchanger additionally comprises a header which distributes the fluid into each of the spaces to which it is connected. This header is formed by openings provided in each of the plates.

The distribution of the fluid within the space between two plates is influenced by the shape of the cross section of the header which supplies the space. On the side of the circuit to which the heat exchanger is connected, the cross section of the pipe is standardized, and this cross section does not facilitate good distribution of the fluid within the space.

Accordingly, the technical problem consists in connecting to the header of the heat exchanger a manifold having a cross section similar to that of the pipe, without unduly degrading the pressure loss of the heat exchanger.

Accordingly, the object of the present invention is to remedy the disadvantage described above by designing a means which allows the header to be connected to the manifold, these two elements having a cross section of different shapes.

Accordingly, the invention relates to a heat exchanger comprising a heating body constituted by a plurality of circulation plates which are fitted into one another and between which there are formed spaces configured to be traversed by a fluid, the heating body comprising at least one header which connects the spaces, the heat exchanger comprising a manifold by which the header is connected to a circuit external to the heat exchanger, characterized in that the header has a header cross section, the manifold has a manifold cross section which is different from the header cross section, the heat exchanger comprising an adapter which is interposed between the header and the manifold and which joins the header cross section to the manifold cross section.

These features allow headers and manifolds having cross sections of different shapes to be used.

Preferably, the fluid is a heat transfer liquid or a refrigerant.

The heating body comprises a stack of circulation plates in a stacking direction d.

According to one embodiment, the circulation plates of the heating body of the heat exchanger have at least one opening of oblong shape.

According to one embodiment of the invention, the adapter is an element which allows a header cross section of oblong shape and a manifold cross section of circular shape to converge.

According to a feature of the invention, the adapter has a flared profile.

The flared profile of the adapter is observed between the longitudinal ends of the adapter, the longitudinal ends being those through which the fluid enters and leaves.

The flared profile is visible in a longitudinal direction of the adapter. The adapter therefore has a first longitudinal end whose cross section has a larger diameter than the second longitudinal end.

According to another feature of the invention, the heating body comprises a first end plate, the adapter being a deformation of the first end plate.

First end plate is understood as meaning the plate that is at the top of the circulation plates in the stacking direction d.

The first end plate therefore corresponds to the upper lateral end of the heating body in the stacking direction d.

Preferably, this adapter according to an embodiment of the invention is produced by stamping the first end plate. The adapter according to this embodiment of the invention is therefore in one piece with the first end plate.

According to another feature of the invention, the heating body comprises a first end plate, the adapter being an independent part having a first end secured to the first end plate and a second end secured to the manifold. These ends are the longitudinal ends of the adapter.

Preferably, the adapter according to the second embodiment of the invention is connected to the manifold by brazing.

Preferably, the adapter according to the second embodiment of the invention is fixed to the opening of the first end plate by brazing.

Advantageously, the adapter comprises at least one bearing stop which bears against the first end plate.

The stop of the adapter allows the insertion of the adapter into the header to be controlled, but also allows the surface area of the zone to be brazed to be increased.

The stop can be an excess thickness which protrudes from the outside wall of the adapter, surrounding the adapter.

The stop can also be a rounded bead which surrounds the adapter and is the result of a deformation of the wall of the adapter.

According to another feature of the invention, the circulation plate comprises at least one opening which delimits the header, the opening comprising at least one edge that is straight at least in part.

The edge is a portion of the bottom of the circulation plate and/or of the first end plate.

The edge delimits the header which channels the refrigerant into the first space of the heating body or the heat transfer liquid into the second space of the heating body.

According to another feature of the invention, the circulation plate comprises a first longitudinal end and a second longitudinal end, the circulation plate comprising at least four openings, of which two openings are provided at the first longitudinal end and two other openings are provided at the second longitudinal end.

Preferably, the two openings provided at the second longitudinal end of the circulation plate each comprise a collar, while the two openings provided at the first longitudinal end of the circulation plate do not have a collar. In this case, the two openings that do not have a collar extend in a plane which is coincident with a plane of a bottom of the circulation plate.

According to one embodiment of the invention, the manifold cross section is circular.

According to a feature of the invention, the header cross section is oblong.

According to a feature of the invention, at least two circulation plates each comprise a bottom and a raised rim which surrounds the bottom, the bottom and the raised rim of a first circulation plate and the bottom and the raised rim of a second circulation plate delimiting the space, the raised rim of the first circulation plate being connected in a sealed manner to the raised rim of the second circulation plate.

Advantageously, the raised rim of the first circulation plate and of the second circulation plate comprise two faces, an upper face and a lower face. Accordingly, the lower face of a raised rim of a first circulation plate comes into contact with the upper face of a raised rim of a second circulation plate.

According to one embodiment of the invention, the heating body is arranged as an alternation of first spaces and second spaces, the first spaces being configured to be traversed by a refrigerant and the second spaces being configured to be traversed by a heat transfer liquid.

Alternation is understood as meaning that two first spaces are not adjacent. Likewise, two second spaces are not immediately adjacent.

According to one embodiment, at least one space has a U-shaped profile. The first spaces and/or the second spaces can have such a U-shaped profile.

According to one embodiment of the invention, the circulation plate has a rib on its bottom.

According to one embodiment of the invention, the circulation plate has flow disruptors on its bottom.

These flow disruptors allow the laminar flow of the heat transfer liquid and of the refrigerant when they are circulating in their respective space to be broken. This feature increases the heat exchanges.

Preferably, the circulation plate and/or the end plate are made of a metallic material, which allows them to be deformed easily, notably by stamping.

Further features, details and advantages of the invention will become more clearly apparent from reading the description, which is provided by way of illustration and with reference to drawings in which.

It should first of all be noted that the figures set out the invention in a detailed manner in order to implement the invention, it being, of course, possible for said figures to serve to better define the invention if necessary.

In the following description, the designations longitudinal or lateral, top, bottom, front, rear refer to the orientation of the heat exchanger according to the invention. The longitudinal direction corresponds to the main axis of the heat exchanger in which it extends, while the lateral orientations correspond to concurrent lines, that is, which cross the longitudinal direction, notably perpendicular to the longitudinal axis of the heat exchanger.

The directions mentioned above are likewise visible in an orthonormal frame of reference LVT shown in the figures.

Figure 1:
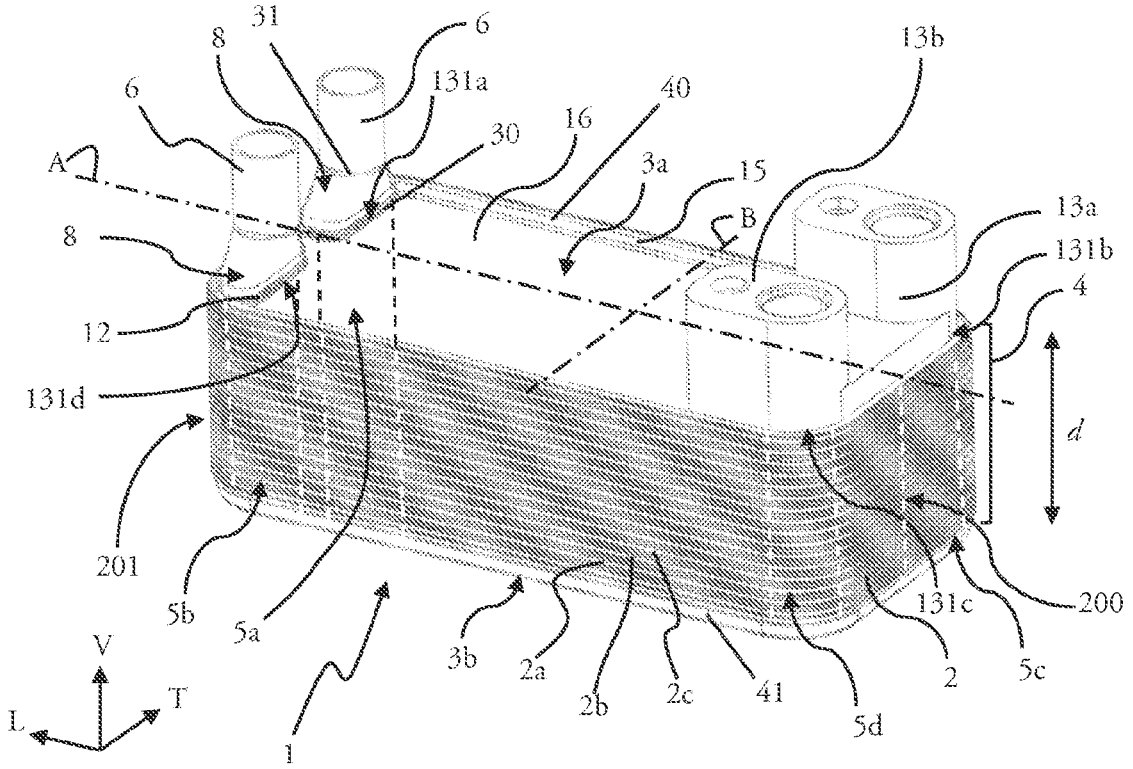
FIG. 1 is a general perspective view of a heat exchanger according to embodiments of the invention.

FIG. 1 shows a heat exchanger 1 according to an embodiment of the invention.

This heat exchanger comprises a stack of circulation plates 2 stacked in a stacking direction d, a first end plate 3*a* and a second end plate 3*b*. This assembly of circulation plates 2, first end plate 3*a* and second end plate 3*b* constitutes the heating body 4 of the heat exchanger 1. The heating body 4 constitutes the location of the heat exchanger 1 at which the heat transfer liquid and the refrigerant exchange calories. The heating body 4 extends in a longitudinal direction and comprises a first longitudinal end 200 and a second longitudinal end 201.

The superposition of the circulation plates 2 delimits a first space which is configured to be traversed by the refrigerant and a second space which is configured to be traversed by the heat transfer liquid. The first spaces 20 and the second spaces 21 are visible in FIG. 5.

A first circulation plate 2*a*, a second circulation plate 2*b* and a third circulation plate 2*c* delimit in pairs the first space and the second space, the spaces being distributed in an alternating manner in the heating body 4. Accordingly, circulation of the refrigerant and of the heat transfer liquid takes place through alternate layers in the heating body 4, along the stacking direction d.

The first space and the second space, as well as the first circulation plate 2*a*, the second circulation plate 2*b* and the third circulation plate 2*c* will be described in detail in the description of FIG. 5.

The first end plate 3*a* is intended to close in a sealed manner the upper part of the heating body 4 in the stacking direction d. This first end plate 3*a* is positioned at the top of the assembly of circulation plates 2 of the heating body 4, in the stacking direction d.

The second end plate 3*b* is intended to close in a sealed manner the lower part of the heating body 4 in the stacking direction d. This second end plate 3*b* is positioned at the bottom of the assembly of circulation plates 2 of the heating body 4 in the stacking direction d.

The first end plate 3*a* and the second end plate 3*b* have a rectangular shape.

The first end plate 3*a* and the second end plate 3*b* have a bottom 16 and a raised rim 15 which surrounds continuously the bottom 16 of the first end plate 3*a* and of the second end plate 3*b*. The first end plate 3*a* and the second end plate 3*b* are therefore configured as a rectangular trough. A bottom of the trough constitutes the bottom 16 and a rim of the trough constitutes the raised rim 15.

The first end plate 3*a* has four openings 131, a first opening 131*a*, a second opening 131*b*, a third opening 131*c* and a fourth opening 131*d*. The four openings 131 are provided through the bottom 16 of the first end plate 3*a*.

The second end plate 3*b* does not have openings, so that the heat transfer liquid and the refrigerant do not leave the heating body 4.

The heating body 4 has headers 5, the function of which is to supply the spaces provided in the heating body 4 with refrigerant or with heat transfer liquid.

A second header 5*b* positioned at the second longitudinal end 201 of the heating body 4 is visible in FIG. 1. A first header 5*a* is positioned opposite the second header 5*b*, along the transverse axis t of the heat exchanger 1 and at the same second longitudinal end 201 of the heating body 4.

The first header 5*a* and the second header 5*b* are volumes which extend in the stacking direction d. The volume of the first header 5*a* and of the second header 5*b* are delimited respectively by the openings of the circulation plates 2, notably by first openings 130*a* and fourth openings 130*d* which are visible in FIG. 2.

The first header 5*a* and the second header 5*b* allow the heat transfer liquid to be distributed or collected in the heating body 4. More precisely, the first header 5*a* and the second header 5*b* allow the second spaces of the heating body 4 to be irrigated.

A third header 5*c* is provided at the first longitudinal end 200 of the heating body 4. A fourth header 5*d* is positioned opposite the third header 5*c* along the transverse axis of the heat exchanger 1 and at the same first longitudinal end 200 of the heating body 4.

The third header 5*c* and the fourth header 5*d* are volumes which extend in the stacking direction d. The volume of the third header 5*c* and of the fourth header 5*d* are delimited by the second openings 130*b* and by the third openings 130*c*, respectively, which are visible in the illustration of the circulation plate 2 shown in FIG. 2.

The third header 5*c* and the fourth header 5*d* allow the refrigerant to be distributed or collected in the heating body 4. More precisely, the third header 5*c* and the fourth header 5*d* allow the first spaces of the heating body 4 to be irrigated.

The heat exchanger 1 comprises a first fixing block 13*a* and a second fixing block 13*b* for the entry and the exit of the refrigerant. The first fixing block 13*a* or the second fixing block 13*b* allow a pipe supplying the heating body 4 with refrigerant to be fixed. The first fixing block 13*a* and the second fixing block 13*b* are positioned in the region of the first longitudinal end 200 of the heating body 4.

At the second longitudinal end 201 of the heating body 4, opposite the first longitudinal end 200 of the heating body 4, there is positioned at least one adapter 8 according to the invention. In the present case, FIG. 1 shows a first adapter 8 and a second adapter 8 according to a first embodiment of the invention.

The first adapter 8 and the second adapter 8 according to the first embodiment of the invention are independent parts, that is to say mounted between a manifold 6 and the first end plate 3*a* and then secured to the manifold 6 and to the first end plate 3*a*. According to an example, at least one of the adapters 8 comprises a bearing stop 12 which allows the insertion of the first adapter 8 or of the second adapter 8 into the first header 5*a* or the second header 5*b*, respectively, to be limited.

The first adapter 8 and the second adapter 8 have a first end 30 in contact with the first end plate 3*a* and a second end 31 in contact with the manifold 6.

The first adapter 8 and the second adapter 8 therefore have a flared configuration from the first end 30 to the second end 31.

The manifold 6 is a tube which allows the first adapter 8 or the second adapter 8 to be connected to a circuit external to the heat exchanger 1. The circuit external to the heat exchanger 1 is, for example, a heat transfer liquid circuit. The external circuit is not shown in the figures.

Figure 2:
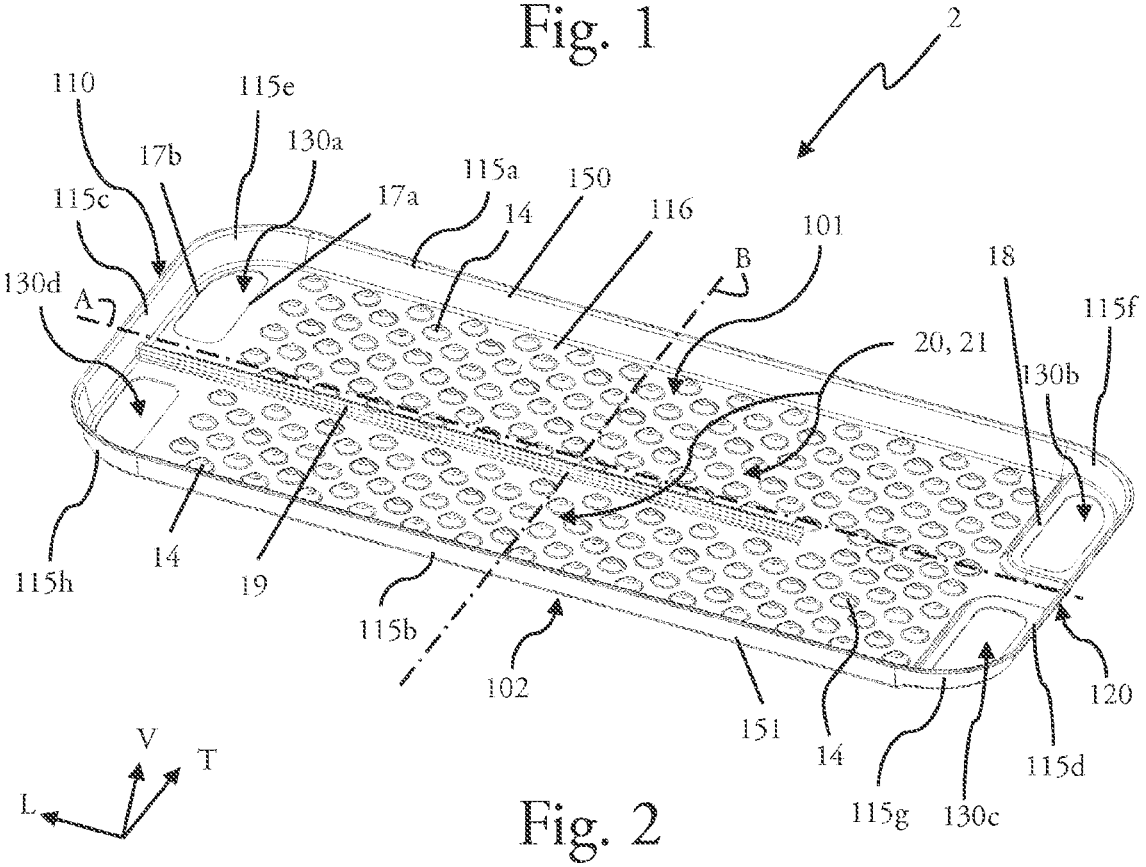
FIG. 2 is a perspective view of a circulation plate according to the invention.

FIG. 2 illustrates a circulation plate 2. The circulation plate 2 has a rectangular bottom 116 and a set of raised rims 115 composed of a first longitudinal raised rim 115*a*, a second longitudinal raised rim 115*b*, a first lateral raised rim 115*c*, a second lateral raised rim 115*d*, a first curved raised rim 115*e*, a second curved raised rim 115*f*, a third curved raised rim 115*d* and a fourth curved raised rim 115*h*.

The first longitudinal raised rim 115*a*, the second longitudinal raised rim 115*b*, the first lateral raised rim 115*c*, the second lateral raised rim 115*d*, the first curved raised rim 115*e*, the second curved raised rim 115*f*, the third curved raised rim 115*d* and the fourth curved raised rim 115*h* surround the bottom 116 peripherally in a continuous manner. The set of raised rims 115 have an upper face 150 and a lower face 151.

The circulation plate 2 extends along a longitudinal axis of the heat exchanger 1 and has a first longitudinal end no and a second longitudinal end 120 opposite the first longitudinal end no. The bottom 116 is delimited by an upper face 101 and by a lower face 102.

The circulation plate 2 has four openings such that a first opening 130*a* and a fourth opening 130*d* are positioned at its first longitudinal end no. A second opening 130*b* and a third opening 130*c* are positioned at its second longitudinal end 120.

The first opening 130*a*, the second opening 130*b*, the third opening 130*c* and the fourth opening 130*d* are each surrounded by an edge 17. The edge 17 is straight in part and its straight part is perpendicular to the first lateral raised rim 115*c* or to the second lateral raised rim 115*d*.

A second part of the edge 17 borders on the one hand the lateral raised rim 115*c*, 115*d* and on the other hand the curved raised rim 115*e*, 115*f*, 115*d*, 115*h* which adjoins the lateral raised rim that is bordered by the edge 17.

In the region of the second longitudinal end 120 of the circulation plate 2, the second opening 130*b* and the third opening 130*c* each comprise a collar 18. The collar 18 is a shoulder which protrudes from the bottom 116 of the circulation plate 2.

It will be noted that only the second opening 130*b* and the third opening 130*c* are provided with a collar 18, the first opening 130*a* and the fourth opening 130*d* not having a collar. The first opening 130*a* and the fourth opening 130*d* are thus formed directly in the bottom 116, forming part of a plane which is coincident with a major extension plane of the bottom 116.

The circulation plate 2 also comprises a rib 19 which extends on the bottom 116 of the circulation plate 2 along the longitudinal axis of the heat exchanger 1. The rib 19 protrudes above the plane AB of the bottom 116 of the circulation plate 2. The rib 19 starts from the first lateral raised rim 115*c*, between the first opening 130*a* and the fourth opening 130*d*. The rib 19 terminates at a non-zero distance from the second lateral raised rim 115*d* and thus divides the volume delimited by the circulation plates 2 to form a first space or a second space having a U-shape.

According to an example, the circulation plate 2 comprises disruptors 14 for disrupting the flow of fluid which are arranged on the bottom 116 of the circulation plate 2. The disruptors 14 are arranged in rows which are parallel to one another and aligned parallel to the transverse direction B. The rows are offset in the transverse direction B in such a manner that the disruptors 14 are arranged so that one row is staggered relative to another, thus forming rows of disruptors 14 parallel to the longitudinal direction A.

All the features of the circulation plate 2 of FIG. 2 also apply to a plurality of circulation plates 2 of the heat exchanger.

Figure 3:
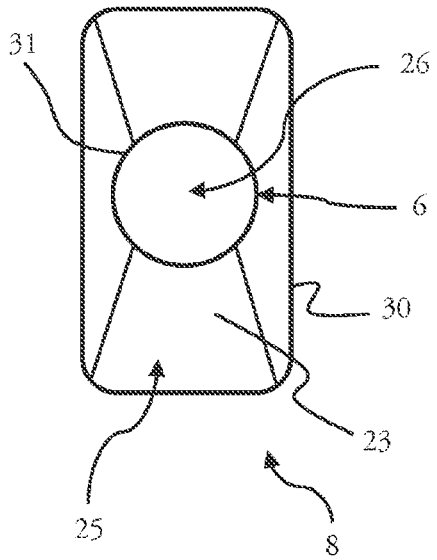
FIG. 3 is a bottom view illustrating schematically the manifold cross section and the header cross section.

FIG. 3 is a diagram illustrating the adapter 8 which joins a header cross section 25 to a manifold cross section 26. The header cross section 25 and the manifold cross section 26 are determined by orthogonal projection onto a plane passing through the opening which receives the adapter 8. The first end 30 of the adapter 8 has a cross section which is identical to the header cross section 25, while the second end 31 of the adapter 8 has a cross section which is identical to the manifold cross section 26.

It will be seen in FIG. 3 that the manifold cross section 26 is different from the header cross section 25. According to this example, the manifold cross section 26 is smaller than the header cross section 25. The adapter 8 therefore widens from its second end 31 to its first end 30 by way of a flare 23.

According to a non-limiting example, the manifold cross section 26 has a circular shape, while the header cross section 25 has an oblong shape.

Figure 4:
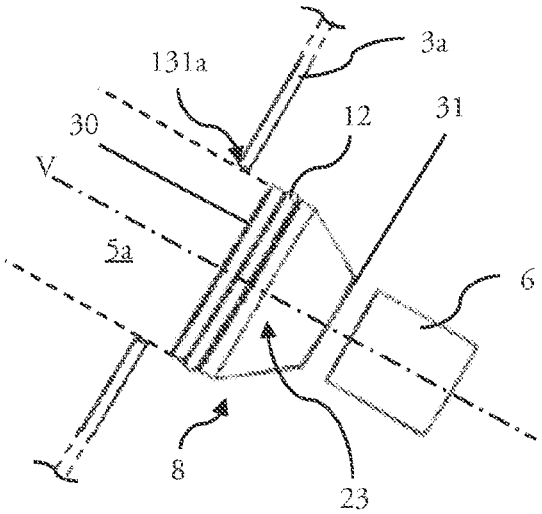
FIG. 4 is an exploded view of a manifold connected to the first end plate by way of an adapter according to the first embodiment of the invention.

FIG. 4 is an exploded view of the adapter 8 according to a first embodiment.

The first end 30 of the adapter 8 is configured to have a shape complementary to the shape of the header cross section 25. The first end 30 of the adapter 8 can accordingly be inserted into the opening in question of the first end plate 3*a*. Likewise, the second end 31 of the adapter 8 is configured to have a shape complementary to the shape of the manifold cross section 26. The second end 31 of the adapter 8 can accordingly be inserted into the opening in question of the first end plate 3*a*.

FIG. 4 also shows the flare 23 of the adapter 8 over its entire length, from the first end 30 having a cross section corresponding to the first header 5*a* to the second end 31 in contact with the manifold 6.

The stop 12 is configured to limit the insertion of the adapter 8 into the first end plate 3*a* by coming into contact with the rim of the opening in question, for example the first opening 131*a*.

All the features mentioned in relation to FIG. 3 apply to the two adapters 8 illustrated in FIG. 1.

Figure 5:
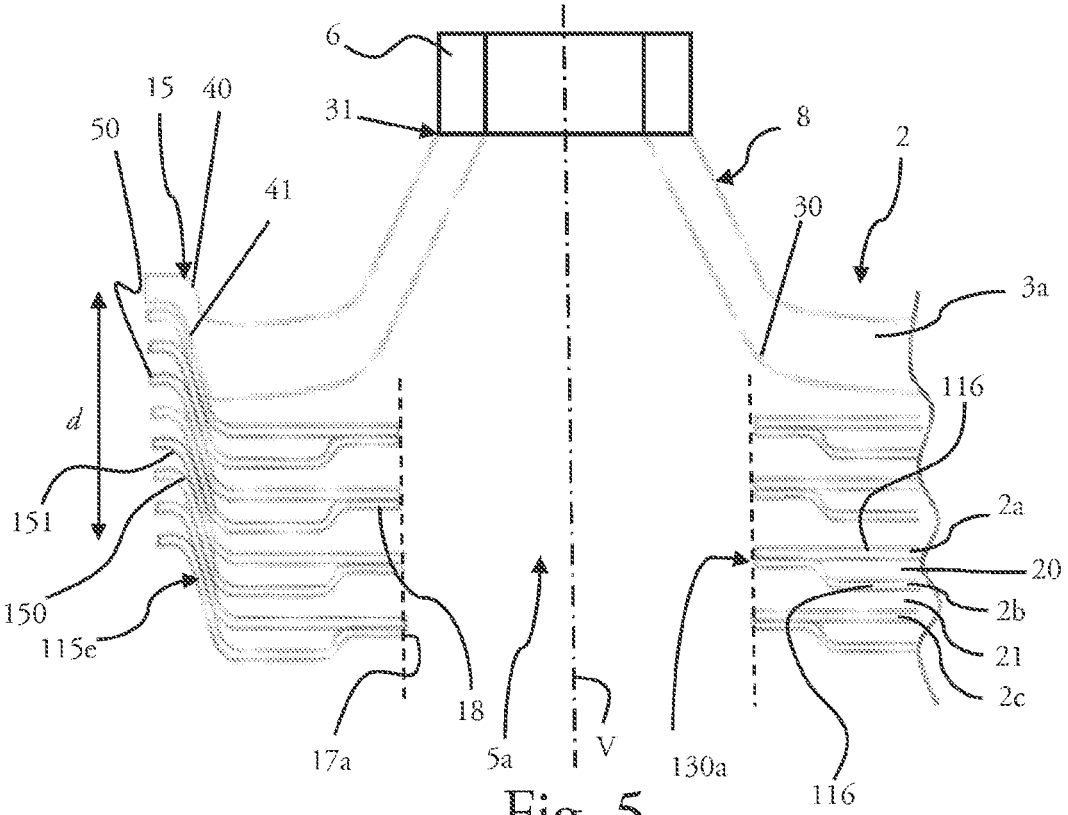
FIG. 5 is a longitudinal sectional view of an adapter according to the second embodiment of the invention.

FIG. 5 is a partial sectional view of the heating body 4 according to the invention. The section is longitudinal in the region of the first header 5*a* of the heating body 4. This section illustrates the interior of a heating body 4 in the region of the first header 5*a* and also the stack of circulation plates 2 and the first end plate 3*a*.

FIG. 5 illustrates, inter alia, the sealing that is achieved between the first circulation plate 2*a* and the second circulation plate 2*b*. The upper face 150 of the raised rim 115 of the second circulation plate 2*b* is in contact with the lower face 151 of the raised rim 115 of the first circulation plate 2*a*. This sealing is achieved notably by brazing of the circulation plates.

FIG. 5 also shows the presence of a peripheral flange 50 which extends in a plane parallel to the plane of the bottom 116 of the circulation plates 2, 2*a*, 2*b*. This peripheral flange 50 extends around each circulation plate 2. Once stacked, the peripheral flange 50 of the first circulation plate 2*a* is at a non-zero distance from the peripheral flange 50 of the second circulation plate 2*b*.

The first space 20 is bordered on one side by the first circulation plate 2*a* and by the second circulation plate 2*b*, while the second space 21 is bordered by that second circulation plate 2*a* and by a third circulation plate 2*c* which is identical to the first circulation plate 2*a*. In this manner, the alternation of first spaces 20 with the second spaces 21 is formed.

The first space 20 is reserved for the refrigerant. In order to prevent the heat transfer liquid from entering the first space 20, the collar 18 is provided around the opening 130*a* of the second circulation plate 2*b*. The second space 21 is reserved for the circulation of the heat transfer liquid in the heating body 4. Accordingly, the first header 5*a* is part of a tubular volume defined the first openings 130*a* provided in the circulation plates 2.

FIG. 5 illustrates the adapter 8 according to a second embodiment . The first end plate 3*a* has a deformation which corresponds to the adapter 8 according to this second embodiment. The adapter 8 is thus a deformation of the plate which has a flared profile along the vertical axis v, so that the first end 30 of the adapter 8 closest to the header has a cross section which is larger than the cross section of the second end 31 which cooperates with the manifold 6.

The invention accordingly achieves the object which it set itself by connecting the header to the manifold even if those components have a significantly different cross section. This fluidic connection is made while reducing the pressure losses, which contributes more generally to increasing the performance of the heat exchanger.

The invention is not limited to the means and configurations exclusively described and illustrated, however, and also applies to all equivalent means or configurations and to any combination of such means or configurations. Notably, if the invention has been described here in its application to a refrigerant/heat transfer liquid heat exchanger, it goes without saying that it applies to any shape and/or size of the adapter, of the header and of the manifold, as long as the latter two have different cross sections.

The invention claimed is:

1. A heat exchanger comprising:

a heating body constituted by a plurality of circulation plates which are fitted into one another and between which there are formed spaces configured to be traversed by a fluid;

the heating body comprising at least one header which connects the spaces;

a manifold by which the at least one header is connected to a circuit external to the heat exchanger;

wherein the at least one header has a header cross section, the manifold has a manifold cross section which is different from the header cross section;

an adapter which is interposed between the at least one header and the manifold and which joins the header cross section to the manifold cross section;

wherein the heating body comprises a first end plate, the adapter being an independent, single-piece part having a first end directly secured to the first end plate and a second end directly secured to the manifold; and wherein the adapter comprises at least one integrally formed bearing stop which protrudes from an outside wall of the adapter such that the bearing stop surrounds the outside wall of the adapter, the bearing stop configured to bear against the first end plate such that the bearing stop limits insertion of the adapter into the first end plate by contacting an outside surface of the first end plate.

2. The heat exchanger as claimed in claim 1, wherein the adapter has a flared profile.

3. The heat exchanger as claimed in claim 1, wherein the plurality of circulation plates comprises at least one opening which delimits the at least one header, the at least one opening comprising at least one edge that is straight at least in part.

4. The heat exchanger as claimed in claim 1, wherein the plurality of circulation plates comprises a first longitudinal end and a second longitudinal end, the plurality of circulation plates comprising at least four openings, of which two openings are provided at the first longitudinal end and two other openings are provided at the second longitudinal end.

5. The heat exchanger as claimed in claim 1, wherein the manifold cross section is circular.

6. The heat exchanger as claimed in claim 1, wherein the header cross section is oblong.

7. The heat exchanger as claimed in claim 1, wherein at least two circulation plates each comprise a bottom and a raised rim which surrounds the bottom, the bottom and the raised rim of a first circulation plate and the bottom and the raised rim of a second circulation plate delimiting the space, the raised rim of the first circulation plate being connected in a sealed manner to the raised rim of the second circulation plate.

8. A heat exchanger comprising:

a heating body constituted by a plurality of circulation plates which are fitted into one another and between which there are formed first spaces configured to be traversed by a refrigerant, and second spaces configured to be traversed by a heat transfer fluid, the heating body comprising at least one header which connects the first spaces and the second spaces;

a manifold by which the at least one header is connected to a circuit external to the heat exchanger;

wherein the at least one header has a header cross section, the manifold has a manifold cross section which is different from the header cross section;

an adapter which is interposed between the at least one header and the manifold and which joins the header cross section to the manifold cross section;

wherein the heating body comprises a first end plate, the adapter being an independent, single-piece part having a first end directly secured to the first end plate and a second end directly secured to the manifold; and wherein the adapter comprises at least one integrally formed bearing stop which protrudes from an outside wall of the adapter such that the bearing stop surrounds the outside wall of the adapter, the bearing stop configured to bear against the first end plate such that the bearing stop limits insertion of the adapter into the first end plate by contacting an outside surface of the first end plate; and wherein the plurality of circulation plates includes flow disruptors on a bottom of each plate, which facilitate breaking of a laminar flow of the heat transfer fluid and of the refrigerant during circulation in the respective first and second spaces.

* * * * *